US006957489B2

(12) United States Patent
Bing et al.

(10) Patent No.: US 6,957,489 B2
(45) Date of Patent: Oct. 25, 2005

(54) METHOD FOR PRODUCING A LIGHT-ALLOY BEARING BUSH WITH A ROUGH EXTERNAL SURFACE

(75) Inventors: Karlheinz Bing, Remseck (DE); Martin Rühle, Stuttgart (DE); Fritz Warth, Stuttgart (DE); Frank Winger, Stuttgart (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/481,947

(22) PCT Filed: Jun. 7, 2002

(86) PCT No.: PCT/DE02/02074

§ 371 (c)(1),
(2), (4) Date: Dec. 23, 2003

(87) PCT Pub. No.: WO03/000447

PCT Pub. Date: Jan. 3, 2003

(65) Prior Publication Data

US 2004/0163256 A1 Aug. 26, 2004

(30) Foreign Application Priority Data

Jun. 23, 2001 (DE) ..... 101 30 416
Apr. 26, 2002 (DE) ..... 102 18 714

(51) Int. Cl.[7] ..... B21K 1/76; B23P 17/00

(52) U.S. Cl. ..... 29/898.054; 29/898.12; 29/527.3; 29/888.061; 164/138; 164/487

(58) Field of Search ..... 29/898.054, 898.059, 29/898.12, 527.3, 888.061; 164/487, 138, 349, 352, 34; 249/87, 114.1; 92/171.1

(56) References Cited

U.S. PATENT DOCUMENTS 2,623,809 A * 12/1952 Myers ..... 29/527.3
2,841,839 A * 7/1958 Roebig ..... 164/513
3,069,209 A * 12/1962 Bauer ..... 92/169.1
3,083,424 A 4/1963 Bruehl
3,210,166 A * 10/1965 Carlson ..... 428/613
3,433,284 A * 3/1969 Williams et al. ..... 164/111
3,684,004 A 8/1972 Germain et al.
4,034,464 A 7/1977 Hetke
5,370,170 A * 12/1994 Sander et al. ..... 164/122.1
5,954,113 A * 9/1999 Buchborn ..... 164/61
6,732,632 B1 * 5/2004 Grahle et al. ..... 92/171.1

FOREIGN PATENT DOCUMENTS

| | | |
|---|---|---|
| CH | 366636 | 1/1983 |
| DE | 3337011 | 4/1984 |
| DE | 19614 949 | 10/1997 |
| DE | 19807688 | 9/1999 |
| DE | 19958185 | 6/2001 |
| EP | 1226889 | 7/2002 |
| FR | 1495568 | 9/1967 |
| FR | 2223117 | 10/1974 |

OTHER PUBLICATIONS

Sodium Silicates Properties. ChemicalLand21.comhttp://www.chemicalland21.com/arokorhi/industrialchem/inorganic/SODIUM%SILICATE.htm.*

Particle Size Chart. http://www.azom.com/details.asp?ArticleID=1417.*

* cited by examiner

*Primary Examiner*—Eric Compton
(74) *Attorney, Agent, or Firm*—Collard & Roe, P.C.

(57) ABSTRACT

The aim of the invention is to produce a light-alloy bearing bush with a rough external surface. To achieve this, particles, which are subsequently surrounded in part by the molten metal, are applied to the surface of the casting mould. When the bearing bush is released from the mould, the particles remain in said bush and are subsequently removed from the bearing bush preform either mechanically or by being dissolved in liquid.

2 Claims, 1 Drawing Sheet

METHOD FOR PRODUCING A LIGHT-ALLOY BEARING BUSH WITH A ROUGH EXTERNAL SURFACE

CROSS REFERENCE TO RELATED APPLICATIONS

Applicants claim priority under 35 U.S.C. §119 of German Application Nos. 101 30 416.1 and 102 18 714.2 filed on Jun. 23, 2001 and Apr. 26, 2002, respectively. Applicants also claim priority under 35 U.S.C. §365 of PCT/DE02/02074 filed on Jun. 7, 2002. The international application under PCT article 21(2) was not published in English.

BACKGROUND OF THE INVENTION

The invention relates to a method for producing a light-alloy bearing bushing having a rough external surface, for an internal combustion engine. Such a method is known from DE 19958185. There, the rough surface of the light-alloy bearing bushing is produced, during casting of the bearing bushing using the lost-foam process, in that the lost-foam casting model of the bearing bushing has an external particle layer with undercuts, which results in a corresponding undercut shape of the external surface of the cast bearing bushing. The rough surface of the bearing bushing is a prerequisite for the fact that a good connection between the bearing bushing and the integral casting material occurs during casting of the bearing bushing.

Furthermore, the production of a brake drum having a rough external surface structure, using the spin casting method, is known from CH 366 636 A, in which method the roughness is produced by means of a refractory mass that is applied to the surface of the casting mold in liquid form and is extremely porous in the dry state, in that the casting metal penetrates into the pores of this lining. However, the use of a spin casting method or pressure casting method is required for this, since here the mere hydrostatic pressure of the molten metal in the form is not sufficient for penetration into the pores of the refractory mass, such as in the chill mold method, for example. Another disadvantage consists of the compulsory mechanical finishing, for example sand blasting, in order to free the surface of the bushing from the adhesions of the refractory mass, so that a quality-appropriate subsequent casting process of the brake drum is assured in the subsequent steps. This type of mechanical finishing reduces the desired roughness to a rather significant extent.

EP 1 226 889 A discloses a method for the production of a rough surface of a work piece, using the sand casting method, in which a lost mold, particularly a sand mold, is also used for casting. Here, the rough structure on the work piece is produced by the sand structure of the casting sand, into which metal oxides or particles that can melt are mixed in order to increase the roughness. It is a disadvantage that a lost mold is used, that additives must be mixed in, and that subsequent mechanical finishing of the rough work piece surface, for example by means of sand blasting, is required.

SUMMARY OF THE INVENTION

The invention concerns itself with the problem of making production of a bearing bushing having a rough external surface possible by means of a re-usable form when using chill casting. In addition, a mechanical finishing of the rough surface after casting is to be avoided.

This problem is solved by means of a method according to claim 1. Advantageous further developments are the object of the dependent claims.

Fixation of the particles is understood to mean that the particles at least do not come loose from the casting mold under the effect of gravity, or float to the top when the melt is filled in. On the other hand, if possible, fixation should be selected to be only so weak that the partially surrounded particles easily come loose from the casting mold when the light-alloy bearing bushing is removed, particularly from a chill mold or a sheet-metal insert for a chill mold. It is particularly preferred if fixation of the particles in the casting mold takes place by means of core binders, such as water glass or known synthetic resins.

It has proven to be advantageous that a grain size of the particles in a range from 0.3 mm to 1.5 mm results in an increase in the specific surface, which is produced by many small undercuts in the particle mixture.

The rough surface does not necessarily have to be present over the entire surface of the bearing bushing, but rather can be restricted to partial regions.

The greatest diameter of the bearing bushing is determined, in the rough region, by the inside diameter of the chill mold or the chill mold insert to which the particles have been applied. During casting, each particle is imaged as a depression, i.e. as a location with a lesser diameter, with reference to the outside diameter of the bearing bushing. Since the particles are accessible from the outside diameter after the bearing bushing has been removed from the mold, they can be dissolved in a liquid. In place of the particles that have been removed, depressions remain in the outside diameter of the bearing bushing blanks.

It is advantageous if the particles consist of salt, as it is also known for the production of salt cores for cooling channels.

BRIEF DESCRIPTION OF THE DRAWINGS

The invention will be explained in greater detail below, using a bearing bushing produced according to the invention. The drawing shows.

DETAILED DESCRIPTION OF THE PREFERRED EMBODIMENT

Figure 1:
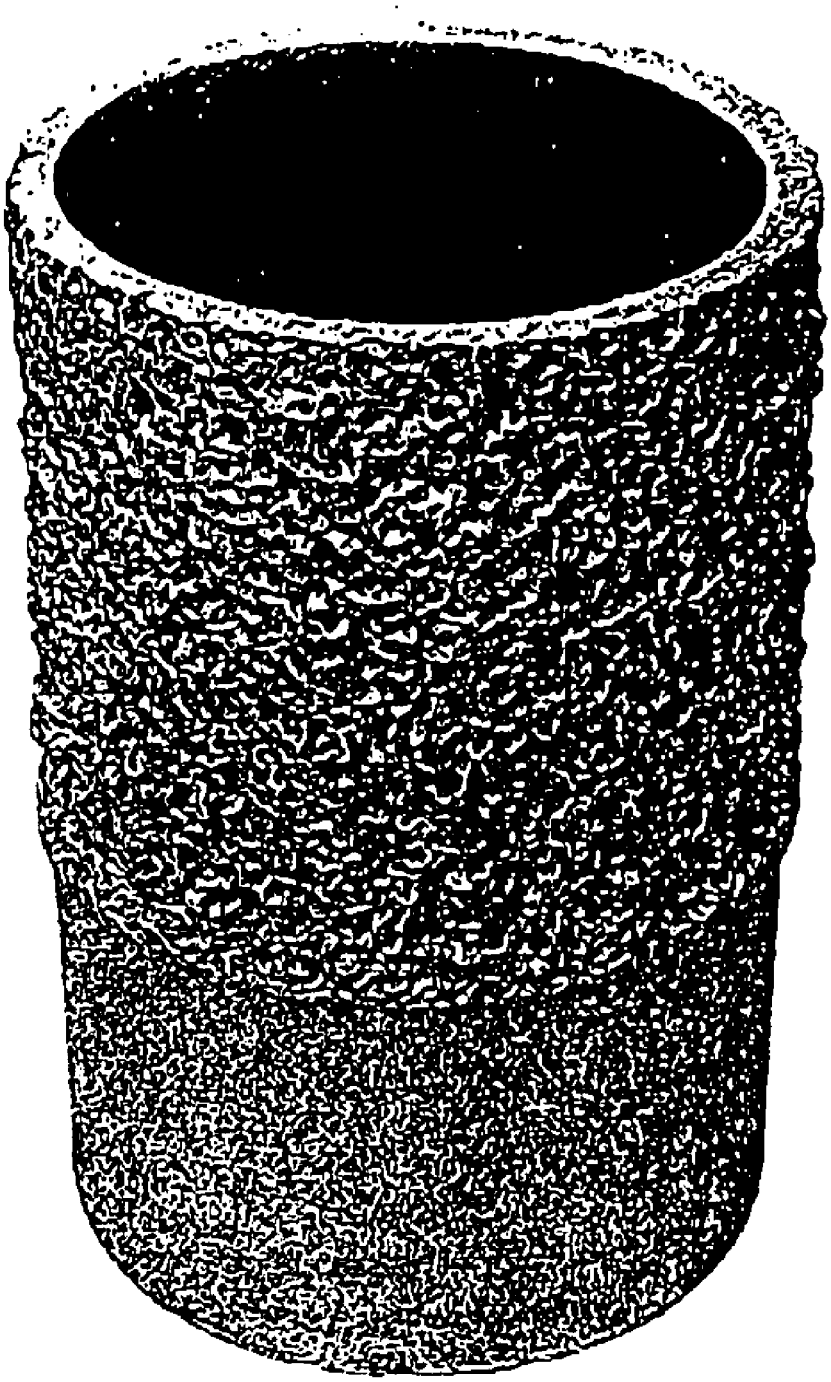
FIG. 1 a bearing bushing having a rough surface in the top region.

The bearing bushing has a fissured surface on the upper approximately 60% of its length, which has been formed by salt particles that were partially surrounded by the molten metal and subsequently dissolved out. In the lower region of the bearing bushing, which has a slightly lesser diameter due to the use of a corresponding chill mold insert, the bearing bushing is comparatively smooth.

What is claimed is:

1. Method for producing a light-alloy bearing bushing for internal combustion engines, having a rough external surface, said method using a chill casting process, wherein particles of a temperature-resistant substance are adhesively fixed in place on the surface of a chill casting mold or a chill casting mold insert for the production of the bearing bushing in the chill casting, subsequently the light-alloy bearing bushing is cast in this casting mold or in this casting mold insert, the bearing bushing is removed from the casting mold or the casting mold insert with the particles, and the particles are removed from the bearing bushing by being dissolved in water.

2. Method for producing a light-alloy bearing bushing according to claim 1, wherein the particle size preferably is 0.3 mm to 1.5 mm.

* * * * *